US005514023A

United States Patent [19]

Warner

[11] Patent Number: 5,514,023

[45] Date of Patent: May 7, 1996

[54] HAND LAUNCHABLE HYDRODYNAMIC RECREATIONAL DEVICE

[76] Inventor: Jon A. Warner, 606 Cowles Rd., Montecito, Calif. 93108

[21] Appl. No.: 201,162

[22] Filed: Feb. 23, 1994

[51] Int. Cl.[6] ..... A63H 23/00

[52] U.S. Cl. ..... 446/153; 273/428; 114/20.1

[58] Field of Search ..... 446/153, 473; 273/416, 420, 423, 428; 114/20.1; 43/6

[56] References Cited

U.S. PATENT DOCUMENTS

| | | | |
|---|---|---|---|
| 1,994,490 | 3/1935 | Skinner . | |
| 2,480,927 | 9/1949 | Hopkins . | |
| 2,925,276 | 2/1960 | Leclerc | 273/428 |
| 3,141,434 | 7/1964 | Van Billiard | 114/20.1 |
| 3,183,002 | 5/1965 | Updaw . | |
| 3,216,727 | 11/1965 | Hunter . | |
| 3,225,488 | 12/1965 | Goldfarb | 273/420 X |
| 3,434,425 | 3/1969 | Critcher . | |
| 3,516,358 | 6/1970 | Manninen et al. . | |
| 3,544,113 | 12/1970 | Hand . | |
| 3,575,123 | 4/1971 | Shepherd | 114/20.1 X |
| 3,727,570 | 4/1973 | Molinski | 114/20.1 |
| 3,754,349 | 8/1973 | Wallace . | |
| 3,915,092 | 10/1975 | Manson et al. . | |
| 4,109,579 | 8/1978 | Carter . | |
| 4,395,965 | 8/1983 | Lang | 114/20.1 |
| 4,448,106 | 5/1984 | Knapp . | |
| 4,463,954 | 8/1984 | Panse et al. . | |
| 4,569,300 | 2/1986 | Ferris et al. | 114/20.1 |
| 4,748,912 | 6/1988 | Garcia . | |
| 4,979,922 | 12/1990 | Clark . | |
| 5,080,017 | 1/1992 | Asikainen . | |
| 5,129,325 | 7/1992 | Matzagg . | |
| 5,306,191 | 4/1994 | Phillips et al. | 273/428 X |

*Primary Examiner*—Robert A. Hafer
*Assistant Examiner*—D. Neal Muir
*Attorney, Agent, or Firm*—Kolisch Hartwell Dickinson McCormack & Heuser

[57] ABSTRACT

A recreational device in the form of an elongate projectile is described. The projectile has a body including a nose region, a mid-region and a tail region. Preferably, the projectile is provided with a fillable cavity for adjusting its buoyancy. The body has a size, mass, length-to-diameter ratio, specific gravity and contour that facilitate its stable distant travel through a liquid medium such as water. Importantly, the projectile has a specific gravity of between 0.95 and 1.05, which renders it neutrally buoyant in most fresh water bodies. In a preferred embodiment of the invention, the recreational device for stabilization purposes against undesirable yaw, pitch and roll has arcuately spaced, radially extending fins in a tail region of the body. When launched by hand underwater, the device maintains an imparted trajectory and slips cleanly through the water over a great distance.

22 Claims, 1 Drawing Sheet

HAND LAUNCHABLE HYDRODYNAMIC RECREATIONAL DEVICE

BACKGROUND OF THE INVENTION

The present invention relates to aquatic recreational devices. More particularly, the invention concerns a hand-launchable projectile that has hydrodynamic properties suitable for controllable, sustainable, long-distance submarine travel.

For millennia, small hand-launched inert (i.e. non-motile) projectiles have been the central object employed in athletic games and sports events. Examples of such games popular at this time are catch, baseball, football, basketball, cricket, handball, disk-flying, boomerang-throwing, etc. In each such game, an airfoil device is passed between teams or players in such a way that points are scored or distance of travel is scored. Each of these projectiles is characterized by several aerodynamic and physical properties. In all cases the object, as it travels in air, creates a small amount of aerodynamic drag relative to the kinetic energy of the projectile. A second feature of these projectiles is their mass and size; all can be hand held and launched by the average person. To allow this to occur the projectile must be small enough to be grasped by the human hand and yet must contain enough mass that the acceleration imparted to it by the human body is maximized, i.e. its kinetic energy at launch is high. Within these constraints, the travel of the projectile will finally and dramatically be determined by its aerodynamic drag. Objects with low drag will travel long distances; those with high drag will not. Virtually all recreational projectiles fall in well-defined ranges of weight, size and aerodynamic drag.

Testimonial to the high level of evolution present in these projectiles is the fact that changes in physical properties of the media in which the projectiles operate have a profound effect on their performance. Increasing the kinematic viscosity of the fluid in which the projectile is launched will reduce the projectile's performance to the point where it is no longer useful as a throwing toy. This results from increased drag on the projectile produced by increased kinematic viscosity of the medium. One may witness this effect while attempting to throw a baseball under water. Water as a travel medium increases drag on the ball, and the ball's buoyancy elevates the ball along its submarine path. The ball's kinetic energy, and hence its travel distance, is reduced by the increased drag.

SUMMARY OF THE INVENTION

It is the object of this invention to tailor hydrodynamic properties, e.g. buoyancy, mass and size, in a class of underwater toys which will provide uses analogous to those of various existing in-air projectiles. Such toys will exhibit low hydrodynamic drag to achieve longer, faster and more controllable travel. They will have size, mass and buoyancy compatible with the human body's ability to impart kinetic energy to a projectile and to catch the projectile at the end of its travel. Applying submarine hydrofoil design principles to a class of airfoil toys produces an entirely new class of underwater toys. Previously unknown recreational activities now can occur in shallow water and swimming pools.

It is still a further object of this invention to employ the property of hydrodynamic lift to hand-launched projectiles in the above class of toys so as to duplicate under water the acrobatics characterizing flying disks, boomerangs and model gliders, none of which would work underwater as they are presently configured. With these invented toys, the hydrofoil is matched to the projectile velocity, mass, buoyancy and size so that the projectile path is modified by the lift (both the horizontal and vertical components thereof) of the foils. Thus, lift will prolong the "flight" of a sinking underwater glider or will cause a prolonged horizontal radial "flight" of an underwater boomerang.

In brief summary, the invention achieves these and other objects in the form of a recreational device in the form of an elongate projectile having a predefined size, mass and low-drag and low-friction hydrodynamic profile and finish. Preferably, the projectile is provided with a fillable cavity for adjusting its buoyancy. The projectile has a size, mass and length-to-diameter ratio that facilitates its stable distant travel through a liquid medium such as water. Importantly, the projectile has a specific gravity of between 0.95 and 1.05, which renders it neutrally buoyant in most fresh water bodies. By neutrally buoyant is meant that the projectile tends to maintain a static submarine elevation and ideally neither floats nor sinks. In a preferred embodiment of the invention, the recreational device for stabilization purposes against undesirable yaw, pitch and roll has arcuately spaced, radially extending fins in a tail region of the body.

These and additional objects and advantages of the present invention will be more readily understood after a consideration of the drawings and the detailed description of the preferred embodiment.

DETAILED DESCRIPTION OF THE INVENTION

Figure 1:
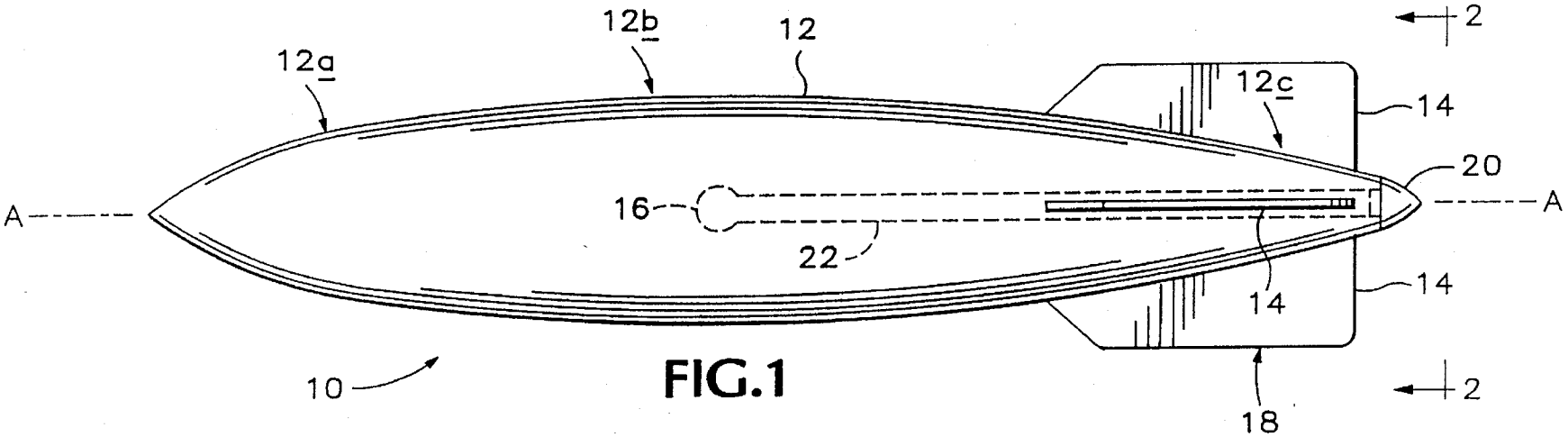
FIG. 1 is a side elevational view of the invented underwater projectile made in accordance with a preferred embodiment.
Figure 2:
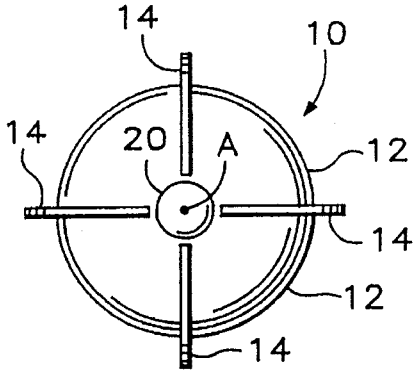
FIG. 2 is an end elevational view of the underwater projectile taken generally along the lines 2—2 of FIG. 1.

Referring collectively to FIGS. 1 and 2, it may be seen that the invention may be described as a hand-launchable projectile or device, indicated generally at 10, for elevation-maintained flight within a liquid medium having a defined density. By elevation maintained flight is meant an aquatic path that is substantially parallel to the surface of the liquid medium, which may take the form of a swimming pool, lake, ocean or the like.

Projectile 10 in turn may be seen to include an elongate body 12 having a nose section 12*a*, a generally cylindrical mid-section 12*b* dimensioned to be grasped by a user's hand for launching the projectile and a tail section 12*c* having plural arcuately spaced stabilizing fins projecting radially from the tail section. Body 12 preferably has a predefined density that is substantially the same as the defined density of such a liquid medium, whereby projectile 10 when launched by hand with the body of the projectile underwater within a plane that is substantially parallel with the surface of the liquid medium tends to remain at a substantially constant elevation therein. Preferably, body 12 includes a substantially sealable cavity 16 formed therein, with cavity 16 being fillable with a material of predefined density to change the predefined density of the projectile relative to that of the liquid medium.

Another way of describing the invention follows. Hydrodynamic recreational device 10 includes body 12 having a nose region 12*a* for confronting a liquid medium when the device is traveling through the medium. As may be seen from the drawings, nose region 12*a* has in cross section defined by at least one plane (e.g. the plane of the drawings) passing through the device's travel path continuously smoothly contoured lines extending substantially symmetrically rearwardly from an apex defining a leading edge of the device to a tail region of the body, the lines in cross section being furthest apart at the approximate fore-to-aft, i.e. lengthwise, center of the elongate body. Body 12 has a frictional coefficient of less than approximately 0.15 and has a specific gravity of between approximately 0.9 and 1.1 relative to a liquid medium in which the device may be made to travel by hand-launching the device.

Preferably, the specific gravity of the body—indeed of device 10 in its entirety—is between approximately 0.95 and 1.05 relative to such liquid, and most preferably is approximately 1.0 relative thereto so that there truly is neutral buoyancy, i.e. no tendency of device 10 either to sink or float. Also preferably, the drag coefficient of the device is less than approximately 0.15, and more preferably is less than approximately 0.12. Those of skill in the art will appreciate that drag coefficient is dependent upon a number of variables including the launch velocity, wear over time on the body's finish, etc. Nevertheless, it is discovered possible to achieve—over a reasonable life of recreational device 10 and under a variety of conditions and use by a variety of users of different skill levels-low drag and thus high performance when the device is made in accordance with the teachings herein.

It may be seen, that device 10 is defined by a smooth body 12 of revolution about a long central axis A and that the ratio of the length (e.g. 16 inches) of the body to the maximum diameter (e.g. 2.73 inches) thereof is approximately 6:1, and is most preferably approximately 5.86:1. Device 10 may be thought of as including drag-producing stabilizing means, indicated generally at 18, adjacent tail region 12*c* of body 12, wherein the lines of body 12 in cross section (refer to the gently curved lines in FIG. 1) are furthest apart slightly fore of the fore-and-aft center of the body (slightly to the left of center in FIG. 1). It may be seen from FIG. 1 that body 12 of revolution is substantially symmetric fore (to the left in FIG. 1) and aft (to the right in FIG. 1) of a plane perpendicular to central axis A of the body, such plane being located where such lines of the cross section are furthest apart, e.g. preferably approximately 7.0 inches aft of nose region 12*a*.

Summarizing now, the illustrated underwater projectile is a low-drag projectile having a mass, size and buoyancy predetermined to provide long distance rapid travel under water. It is easily hand-launched or thrown and caught underwater. In one application it is used as an underwater 'ball' where it can be used in games such as catch, dodge ball, as well as distance and target throwing.

Invented projectile 10 is a hand-launched underwater projectile analogous to the hand-thrown air ball. It achieves this analogous action under water by having a relatively high mass, adjustable buoyancy (from positive to negative) and very low hydrodynamic drag. In order to maintain a low drag coefficient and directional stability the aft section of the projectile contains plural and preferably four equally spaced stabilizing foils 14. These create, strong righting moments in the event the projectile yaws or pitches in its underwater trajectory. Projectile 10 in its preferred embodiment employs some aerodynamic features which allow it to make a smooth transition from an in-air trajectory to an underwater path. Specifically, the stabilizing foils are designed to provide an anti-yawing and anti-pitching moment in air as well as in water, thus allowing the projectile to make a clean directionally stable entry to the water, through the airwater interface. Some rather interesting hydrodynamic acrobatics result from a substantially horizontal, but slightly downwardly inclined launch of recreational device 10, as described herein, into a swimming pool from an adjacent deck.

In accordance with the preferred embodiment of the invention illustrated in FIGS. 1 and 2, the projectile contains a fillable internal cavity 16 which allows buoyancy adjustment. Removing its plug 20 from a central bore 22 (enlarged for clarity in FIG. 1) and adding water allows the buoyancy of the projectile to be adjusted. For lake or ocean applications, it is adjustable to provide positive buoyancy, or a slight floating tendency, for ease of recovery. In swimming pools the projectile can be adjusted for negative buoyancy, or a slight sinking tendency, which facilitates certain games. Such a cavity may be formed within device 10 during the molding process or may be bored at a later time. It may take alternative forms from that shown in FIGS. 1 and 2, within the spirit and scope of the invention.

Recreational device 10—especially nose region 12*a* thereof—may be made of a low-durometer (soft) polyurethane which prevents personal injury to the users and does not leave marks on the walls of swimming pools. The extremely low drag characteristic of projectile 10 is achieved by its fusiform body which after much development has the form defined by the following table denoting body diameters at different distances from the body's leading edge along the body's long axis A (refer also to FIG. 1).

TABLE 1

| Distance from leading edge | Diameter |
|---|---|
| 1.00 inches | 1.29 inches |
| 2.00 inches | 1.90 inches |
| 3.00 inches | 2.25 inches |
| 4.00 inches | 2.47 inches |
| 5.00 inches | 2.63 inches |
| 6.00 inches | 2.71 inches |
| 7.00 inches | 2.73 inches |
| 8.00 inches | 2.67 inches |
| 9.00 inches | 2.57 inches |
| 10.00 inches | 2.40 inches |
| 11.00 inches | 2.19 inches |
| 12.00 inches | 1.94 inches |
| 13.00 inches | 1.63 inches |
| 14.00 inches | 1.24 inches |
| 15.00 inches | 0.69 inches |
| 16.00 inches | 0 inches |

It may be seen from Table 1 and FIG. 1 that body 12 of device 10 is substantially symmetrical about a plane normal to its long axis A, which plane is located preferably approximately 7.0 inches rearwardly from the extreme forward tip, or nose, of, or slightly fore of the lengthwise center, of body 12. This preferred slight forward bias of the region of maximum diameter of body 12 compensates for the weight of fins 14 and results in a substantially lengthwise central location of the center of mass of device 10. It will be appreciated that, in accordance with the preferred embodiment of the invention, the region of maximum diameter of body 12 is located rearward of the body's nose approximately 7/16 of the body's overall length. It also may be seen from Table 1 and FIG. 1 that body 12 has an overall length-to-width ratio of approximately 6:1, which has been discovered to be important to achieving the desired hydrodynamic stability.

It is noted that, as an alternative to the embodiment illustrated best in FIG. 1, the forward, tip of nose region 12*a* may be rounded for safety considerations, e.g. with up to a ¼ inch radius and need not be sharp or pointed, as might be expected, for purposes of hydrodynamic propulsion and stability. This is because the illustrated body of revolution for body 12 ensures that there is substantially only laminar aquatic flow in and around the forward regions of device 10. Those skilled in the art will appreciate that the body of revolution and length-to-maximum diameter ratio of body 12 ensures that any detached aquatic flow occurs behind the plane described above that is located 7.0 inches rearward the tip of nose region 12*a*. Any such detached flow occurring behind the region of maximum diameter of body 12, it will be appreciated, is actually helpful in impelling device 12 forward along its underwater trajectory.

Stabilizing fins 14 of projectile 10 preferably occupy the aft 25% of the body and are in height or radial extent 105% of the maximum diameter of body 12, as seen by reference to FIGS. 1 and 2, respectively. These fin dimensions are believed to represent an optimum tradeoff between stability and range for device 10 (those skilled in the art will appreciate that fins 14 produce a small amount of drag that is needed to stabilize device 10 against yaw, pitch and roll). Alternate fin arrangements or alternate stabilization means 18 in general, within the spirit and scope of the invention, may be provided.

Within the spirit and scope of the invention, device 10 may be made from any suitable material such as polyurethane having sufficient density to achieve the desired mass that achieves the needed high kinetic energy. In accordance with the preferred embodiment described and illustrated herein, device 10 weighs substantially approximately 1002 grams, which according to its volume produces a desirable specific gravity of precisely 1.0 (corresponding with pure water—as described herein, such may be adjusted for higher saline, e.g. ocean, water).

Thus, numerous modifications to the invention are contemplated, and are believed to be within the spirit and scope of the invention. Such include alternative embodiments of underwater projectiles some of which more resemble flying disks, boomerangs and model gliders than they do rockets or darts. Some exemplary alternative embodiments are described briefly below.

A proposed underwater 'flying' disk is a low-drag lifting body capable of underwater gliding and obtains vertical lift when launched underwater with a spinning motion. Such a disk may be made with a circular peripheral region that is similar in cross section to region 12*a* of elongate projectile 10.

A proposed low-drag version of the boomerang has physical properties which match it to the underwater environment and allow for a horizontal radial underwater 'flight'. Again, its leading, water-confronting edges may resemble nose region 12*a* of projectile 10.

The proposed underwater glider employs gravity and lift to generate a long gliding motion. It can also be accelerated by throwing or springing action such as rubber bands to glide long distances underwater. Adjustable control planes allow for tuning its underwater 'flight'. Again, its leading hydrofoil edges may be fashioned after nose region 12*a* in pertinent cross section.

Any of the above embodiments of the invention might be adapted for sling or other assisted launching, as well as for simple hand-launching. For example, a sling launcher (not shown) for the above projectiles may be provided.

OPERATION

Briefly, it will be appreciated that, in operation, recreational device 10 may be grasped by hand at a suitable location along body 12, e.g. preferably in mid-region 12*b* thereof, in a desired orientation and propelled forward preferably along its long axis A in a liquid medium such as a body of fresh or salt water. Because of its mass, structure and specific gravity, as described in detail above, device 10 continues along its user-imparted launch trajectory smoothly and without appreciably pitching, yawing or rolling. More importantly, device 10 preferably neither surfaces nor sinks, but instead maintains what is referred to herein as a neutral buoyancy at its original submarine elevation. Also importantly, because of its described and illustrated hydrodynamic design, device 10 slices through the liquid medium with minimal friction or drag and thus travels at high speed over a great distance. Yet the aquatic device is safe as well as fun due to the choice of materials and nose configuration.

While the present invention has been shown and described with reference to the foregoing preferred embodiment, it will be apparent to those skilled in the art that other changes in form and detail may be made therein without departing from the spirit and scope of the invention as defined in the appended claims.

I claim:

1. A hand-launchable projectile for submarine movement within a body of water having a specific density, the projectile comprising:

an elongate body including a nose section, a generally cylindrical mid-section dimensioned to be gasped between circumferentially extending thumb and opposing curved fingers in the crook of the thumb of a user's hand for launching the projectile and a tail section having plural arcuately spaced stabilizing fins projecting radially from the tail section, the body having a surface preparation producing a low drag coefficient and a predefined density that is substantially the same as, and within ±10% of, the specific density of the body of water, whereby the projectile when launched submarine by hand tends to travel along a substantially straight line path.

2. The projectile of claim 1, wherein the body includes a substantially sealable cavity formed therein, said cavity being fillable with a material of predefined density to change the predefined density of the projectile relative to that of the liquid medium.

3. A hydrodynamic recreational device comprising:

a body including a nose region for confronting a body of water when the device is traveling through the medium, said nose region having in cross section defined by at least one plane passing through the device's travel path continuously smoothly contoured lines extending substantially symmetrically rearwardly from an apex defining a leading edge of the device to a tail region of the body, the lines in cross section being furthest apart at the approximate fore-to-aft center of the elongate body and positioned to give maximum stability when hand-launched, the body being substantially smoothly arcuately contoured from the leading edge to the tail region thereof to produce a drag coefficient of less than approximately 0.15 and the body being formed of one or more materials that produce in the body a specific gravity of between approximately 0.9 and 1.1 relative to a body of water in which the device may be made to travel by hand-launching the device.

4. The device of claim 3, wherein the specific gravity of the body is between approximately 0.95 and 1.05 relative to such liquid.

5. The device of claim 3, wherein the drag coefficient of the device is less than approximately 0.15.

6. The device of claim 3, wherein the drag coefficient of the device is less than approximately 0.12.

7. The device of claim 3, wherein the specific gravity of the body is between approximately 0.95 and 1.05 relative to such liquid and wherein the drag coefficient of the device is less than approximately 0.15.

8. The device of claim 3, wherein the device is defined by a smooth body of revolution about a long central axis and wherein the ratio of the length of the body to the maximum diameter thereof is approximately 6:1.

9. The device of claim 8 which further comprises drag-producing stabilizing means adjacent the tail region of the body, wherein the lines of the body in cross section are furthest apart slightly fore of the fore-and-aft center of the body.

10. The device of claim 9, wherein the body of revolution is substantially symmetric fore and aft of a plane perpendicular to the central axis of the body, such plane being located where such lines of the cross section are furthest apart.

11. A hand-launchable projectile for submarine movement within a body of water having a defined specific gravity, the projectile comprising:

an elongate body having a long central axis, the body including a nose section defining a smooth continuous water-confronting surface, a generally cylindrical mid-section dimensioned to be grasped between at least semicircumferentially extending thumb and opposing fingers of a user's hand for launching the projectile and a tail section including plural arcuately spaced stabilizing fins projecting from the tail section radially in at least one plane containing the central axis of the body, the body having a predefined specific gravity that is substantially the same as, and within ±10% of, the defined density of such water, whereby the projectile when launched by hand within the water travels therein along a substantially straight-line trajectory of its launch.

12. The projectile of claim 11, wherein the nose section smoothly tapers forwardly from the mid-section substantially to a first point and wherein the tail section smoothly tapers rearwardly from the mid-section substantially to a second point.

13. The projectile of claim 12, wherein the tail section includes at least three fins that are substantially equally arcuately spaced around the tail section's circumference.

14. The projectile of claim 12, wherein the tail section includes plural pairs of oppositely extending fins.

15. The projectile of claim 14, wherein the tail section includes at least two pairs of oppositely extending fins, with the pairs of fins extending in planes that are substantially orthogonal to one another.

16. The projectile of claim 12, wherein the elongate body is substantially smoothly contoured from the first point to the second point.

17. The projectile of claim 11, wherein the projectile is formed of one or more materials that produce in the projectile a specific gravity of between approximately 0.9 and 1.1 relative to the body of water and wherein the body has a smoothly arcuate hydrodynamic profile from a forward point to a rearward point and includes a smooth surface preparation that produces a drag coefficient of less than approximately 0.15.

18. The projectile of claim 17, wherein the projectile is substantially defined by a smooth body of revolution about the central axis and wherein the ratio of the length of the body to the maximum diameter thereof is approximately 6:1.

19. The projectile of claim 18, wherein the body of revolution is substantially symmetric fore and aft of a plane orthogonal to the central axis of the body, such plane being located substantially midway through the length of the body of revolution.

20. The projectile of claim 19, wherein the center of gravity of the projectile is located substantially at a center of pressure of the projectile.

21. The projectile of claim 20 which further comprises a substantially sealable cavity formed therein, said cavity being fillable with a material of predefined specific gravity to change the predefined specific gravity of the projectile relative to that of the body of water.

22. A hand-launchable projectile for sustained submarine movement within a body of water having a defined specific gravity, the projectile comprising:

a body including a nose section and a mid-section dimensioned to be gasped by a user's hand for launching the projectile, the body having a central axis, the body further including a tail section including plural arcuately spaced stabilizing fins projecting from the tail section radially in at least one plane containing the central axis of the body, the body being formed with a surface preparation that results in a drag coefficient of less than approximately 0.15, the body having a specific gravity that is substantially the same as, and within ±10% of, the defined specific gravity of the body of water, the body being dimensioned to have a characteristic length that produces a Reynolds number of flow within the body of water at a time when the body is launched by hand of less than approximately $5.0\times10^6$, whereby the projectile when launched by hand exhibits neutral buoyancy and stability in sustained submarine movement.

* * * * *